United States Patent [19]

Stachitas

[11] 4,443,282

[45] Apr. 17, 1984

[54] METHOD OF EXTERNALLY SEALING SEWAGE SYSTEM JOINTS AGAINST ENTRY OF GROUND WATER TO THE SYSTEM

[76] Inventor: Bruce L. Stachitas, 4500 Dustin Rd., Burtonsville, Md. 20730

[21] Appl. No.: 373,526

[22] Filed: Apr. 30, 1982

[51] Int. Cl.[3] ..... B32B 31/00; B28C 19/00

[52] U.S. Cl. ..... 156/152; 29/450; 29/458; 29/460; 285/230; 285/235; 285/DIG. 16; 156/294

[58] Field of Search ..... 29/458, 460, 450; 285/DIG. 16, 230, 235; 156/294, 152, 295

[56] References Cited

U.S. PATENT DOCUMENTS

| | | | |
|---|---|---|---|
| 2,621,507 | 12/1952 | Pharris et al. | 156/152 X |
| 2,741,267 | 4/1956 | McKinley | 156/294 X |
| 2,944,588 | 7/1960 | Sannipoli et al. | 156/152 X |
| 3,100,658 | 8/1963 | Miller et al. | 285/230 |
| 3,146,485 | 9/1964 | Evans et al. | 156/152 X |
| 3,228,712 | 1/1966 | Hausmann et al. | 285/DIG. 16 UX |
| 3,274,330 | 9/1966 | Becker et al. | 29/450 UX |
| 3,276,929 | 10/1966 | Ferch | 156/294 X |
| 3,756,631 | 9/1973 | Ross et al. | 285/230 |
| 3,826,521 | 7/1974 | Wilhelmsen | 156/294 X |
| 3,848,904 | 11/1974 | Anderson | 285/DIG. 16 UX |
| 3,907,351 | 10/1959 | Rohrback et al. | 29/450 UX |
| 4,023,834 | 5/1977 | Ewing et al. | 285/235 |

FOREIGN PATENT DOCUMENTS

| | | | |
|---|---|---|---|
| 971124 | 9/1964 | United Kingdom | 285/235 |
| 1246055 | 9/1971 | United Kingdom | 285/235 |

*Primary Examiner*—Charlie T. Moon

*Attorney, Agent, or Firm*—Wilkinson, Mawhinney & Theibault

[57] ABSTRACT

The present disclosure is directed to a method of externally sealing underground sewage system joints against entry of ground water to the system and which requires placing a continuous elastomeric band about a first one of the joint elements prior to its interconnection with the adjacent joint element, then interconnecting the adjacent element to said first element, and thereafter positioning the elastomeric band so that it substantially equally overlies the joint between said first and second elements with one-half of the band width overlying each element. The elastomeric band is then folded back upon itself from one of said elements and applying a mastic coating to the surface of the element thereby exposed and folding the band back over the element and mastic coating, subsequently the elastomeric band is folded back upon itself from the other adjacent element and a mastic coating is applied to the external surface of the adjacent element thereby exposed and the band is folded back over the element and mastic coating to form an externally sealed joint between two adjacent interconnected sewage system elements having an elastomeric band about the joint adhered to the adjacent members of the joint by a mastic to repel ground water from entering the sewage system externally, and finally back filling to bring the area around either the conduit or manhole to grade covering and protecting the sewage system.

3 Claims, 7 Drawing Figures

METHOD OF EXTERNALLY SEALING SEWAGE SYSTEM JOINTS AGAINST ENTRY OF GROUND WATER TO THE SYSTEM

TECHNICAL FIELD

My invention is directed to the external sealing of underground sewage system joints of both the manhole type and conduit or pipe type against the entry of ground water into the sewage system.

BACKGROUND ART

Heretofore elastic bodies have been wrapped about pipe joints externally to seal against entry of ground water into a sewage system such as disclosed in U.S. Pat. No. 3,100,658 and also an external seal is shown in U.S. Pat. No. 3,756,631.

DISCLOSURE OF THE INVENTION

The present invention is directed to a novel method of applying an elastomeric band externally about the joint elements of either manhole sections stacked vertically or pipes or conduits laid horizontally or between manholes which band extends to each side of the joint and provides a contiguous surface about the elements it is to seal over the joint area and is bonded to the elements with a mastic.

Another object of my invention is its novel method of application of the elastomeric band over the joint, rolling the band back halfway, applying a sealing mastic over the area of the element the elastomeric band will overlie when rolled back upon the element coated with the mastic coating. The band to the other side of the joint is rolled back upon itself and a mastic coating is applied to the area of the element it will overlie when rolled back flat to overlie the mastic. This then produces an external seal which compresses radially inwardly about the joint, is continuous without air or water holes and which is sealed against the elements overlying the joint and is bonded to each element forming the joint with a mastic.

A further object of the present invention is to provide externally sealed joints in a sewage system to exclude entry of ground water thereto to reduce the volume of liquid to be treated at the sewage treatment plant since the present entry of ground water overloads treatment plants and results in housing construction moratoriums until increased treatment facilities can be built and placed on line.

THE BEST MODE FOR CARRYING OUT THE INVENTION

Figure 1:
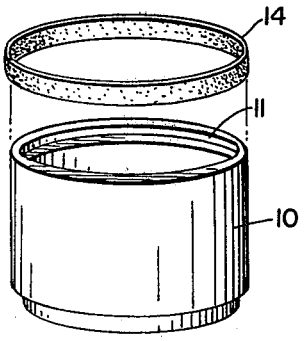
FIG. 1 is a perspective view of a manhole bell section with the elastomeric band poised above the section prior to its application thereto.
Figure 3:
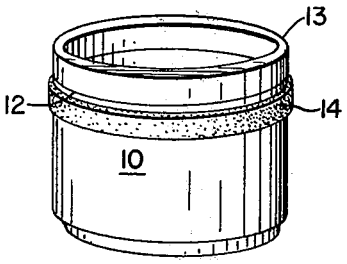
FIG. 3 is a perspective view of the casing of FIG. 1 showing the elastomeric band applied to the bell end casing and a spigot section applied thereto.
Figure 5:
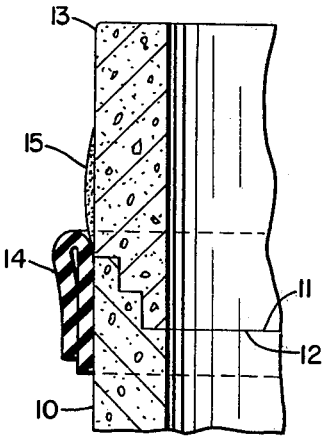
FIG. 5 is a fragmentary vertical sectional view through the bell and spigot casings of FIG. 4 with the band rolled back and the mastic applied to the spigot section casing.

Referring now to FIG. 1, a cylindrical manhole section 10 is shown which most commonly is of concrete and which has a bell end 11 to receive the spigot end 12 of a mating section 13 as shown in FIGS. 3 and 5. Poised above the manhole section 10 is a large elastomeric continuous band 14 whose internal diameter is less the external diameter of the manhole section 10. The band 14 may be of a width varying from 6 to 10 inches, depending upon the diameter of the casing or conduit to be sealed and the band may be from ¼" to ½" thickness.

Figure 2:
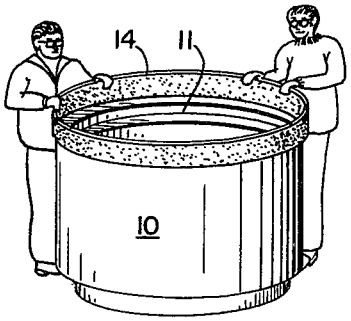
FIG. 2 is a perspective view of two men applying the elastomeric band of FIG. 1 to the manhole section.
Figure 4:
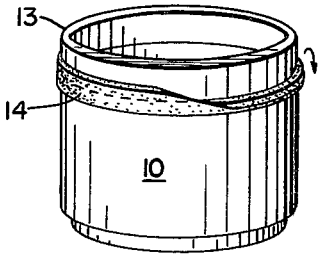
FIG. 4 is a perspective view of the manhole casings of FIG. 3 with the band positioned equally to each side of the joint between the manhole bell and spigot casings with the upper portion of the band rolled back upon itself for application of the sealing mastic to spigot casing prior to rolling the upper portion of the band over the mastic to seal it with the casing.
Figure 6:
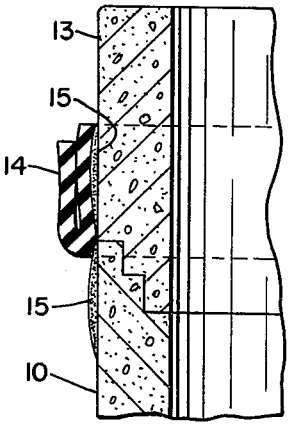
FIG. 6 is a fragmentary vertical sectional view through the bell and spigot casings of FIG. 4 with the band rolled back and the mastic applied to the bell section casing.

As shown in FIG. 2, the elastomeric band 14 is stretched about the casing 10 and worked downwardly to the position shown in FIG. 3 so that the mating section 13 can be set in place and sealed at the bell and spigot joint. Thereafter the band is worked upwardly so it will overlie the joint equally to each side thereof. Thereafter as shown in FIGS. 4 and 6 the band is rolled back upon itself and a coating of mastic 15 is applied to the manhole element 13 and the band 14 is rolled back over the mastic 15 as shown in FIG. 5.

Figure 7:
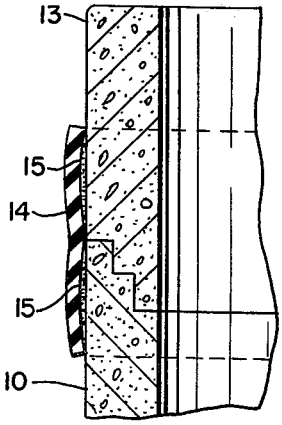
FIG. 7 is a fragmentary vertical sectional view through the bell and spigot casings of FIG. 4 with the band in place over the mastic to seal the joint between both bell and spigot casings to seal the joint therebetween externally.

The portion of the band which overlies the manhole section 10 is then rolled back in a like manner and the mastic 15 is applied to the manhole section 10 as shown in FIG. 7. The band 14 is then rolled back over the mastic 15 to overlie it so it will form the externally sealed joint shown in FIG. 5.

The band 14 may be of a natural gum rubber or a synthetic elastomer whose composition may vary dependent upon the chemistry of the soil in the area where either the manhole or conduits are laid. The soil and ground water may have a deteriorating effect upon the band 13 so that the composition of the elastomer may have to be varied. The band 14 is a continuous ring as shown in FIG. 1, the internal diameter of which will have to be less than the external diameter of manhole casing or conduit to be sealed and provide sufficient elasticity to firmly grip the casing or conduit to be sealed to exclude either water or air entering the joint being sealed.

Both manhole casings and conduits vary in diameter such as some may be 2 ft. in diameter while others may be 4 ft. or 6 ft. in diameter.

The mastic 15 which forms the sealing bond between the inner diameter of the elastomeric band and the external diameter of the manhole casing 10 or conduit has been found satisfactory when being a roof and foundation coating which is a mixture of asphalt and mineral spirits so long as it retains its water proofing characteristics.

While the term adjacently interconnected elements is used in the claims it means two complemental interconnected sections of bell and spigot manhole sections or two complemental interconnected bell and spigot pipe sections.

What I claim is:

1. The method of preventing entry of ground water into a sewage system through joints between adjacently interconnected large diameter tubular elements thereof comprising:

(a) placing an elastomeric band about a first one of the elements prior to its interconnection with the adjacent element, (b) interconnecting the adjacent element to said first element, (c) positioning the elastomeric band so that it substantially equally overlies the joint between said first and second elements with one-half of the band width overlying each element, (d) folding the elastomeric band back upon itself from one of said elements and applying a mastic coating to the surface of the element thereby exposed and folding the band back over the element and mastic coating, (e) thereafter folding the elastomeric band back upon itself from the other adjacent element and applying a mastic coating to the surface of the adjacent element thereby exposed and folding the band back over the element and mastic coating to form an externally sealed joint between two adjacent interconnected sewage system elements having an elastomeric band about the joint adhered to the adjacent members of the joint by a mastic to repel ground water from entering the sewage system externally.

2. The method of claim 1 wherein the adjacently interconnected elements are manhole sections vertically stacked one upon another.

3. The method of claim 1 wherein the adjacently interconnected elements are sewer pipe conduit sections on lines between manholes.

* * * * *